US006070397A

United States Patent [19]

Bachhuber

[11] Patent Number: 6,070,397

[45] Date of Patent: Jun. 6, 2000

[54] SELF SEALING STORAGE SYSTEM AND PATCH THEREOF

[76] Inventor: Michael W. Bachhuber, 10 Tower Dr., Mayvill, Wis. 53050

[21] Appl. No.: 09/062,541

[22] Filed: Apr. 17, 1998

Related U.S. Application Data

[60] Provisional application No. 60/039,359, Apr. 19, 1997.

[51] Int. Cl.[7] ..... B65B 31/08

[52] U.S. Cl. ..... 53/512; 206/524.8; 141/329

[58] Field of Search ..... 141/313, 329; 206/524.8; 426/418, 404; 53/432, 434, 510, 512, 415, 133.4, 136.1, 136.5; 383/43

[56] References Cited

U.S. PATENT DOCUMENTS

| | | | |
|---|---|---|---|
| 2,316,607 | 4/1943 | MacDonald | 53/434 X |
| 2,704,075 | 3/1955 | Cherkin | 141/329 |
| 2,764,859 | 10/1956 | Hanselmann . | |
| 2,862,528 | 12/1958 | Geisler | 53/510 X |
| 3,496,969 | 2/1970 | Bruce et al. | 141/329 |
| 4,337,804 | 7/1982 | Maruscak | 141/65 |
| 4,754,595 | 7/1988 | Sanderson | 53/425 |
| 4,919,955 | 4/1990 | Mitchell | 53/432 X |
| 5,035,103 | 7/1991 | Akkala | 53/434 |
| 5,228,271 | 7/1993 | Wallace | 53/434 |
| 5,396,751 | 3/1995 | Chi | 53/510 |
| 5,481,852 | 1/1996 | Mitchell | 53/432 |
| 5,551,213 | 9/1996 | Koelsch et al. | 53/434 |
| 5,598,584 | 2/1997 | Aarts | 53/434 |

*Primary Examiner*—Linda Johnson
*Attorney, Agent, or Firm*—Gene Scott-Patent Law & Venture Group

[57] ABSTRACT

The present invention provides a means and method of exhausting air from, and sealing a container of the type used for sealing food products. The means includes a self adhering patch for attachment to the exterior side wall of the container, or alternately, a patch that is constructed as part of a commercial container such as a baggie, and a suction probe which may be attached to a source of suction such as a suction pump for drawing air from the container when the suction probe is inserted through the patch and into the container. When the air has been removed, the probe is removed and the patch self-closes to seal the puncture.

4 Claims, 2 Drawing Sheets

SELF SEALING STORAGE SYSTEM AND PATCH THEREOF

This application is based upon a prior filed Provisional application, Ser. No. 60/039,359 dated Apr. 19, 1997 and claims the priority date thereof.

BACKGROUND OF THE INVENTION

1. Field of the Invention

This invention relates generally to storage containers especially of the type for storing goods, including foodstuffs, that might be damaged over time by air within the storage container, and more particularly to a storage container and air removal system employing suction and a self sealing patch.

2. Description of Related Art

The following art defines the present state of this field:

Aarts, U.S. Pat. No. 5,598,684 describes The invention relates to a method and apparatus for producing a vacuum package filled with granular material. A package made from a flexible film is filled with granular product. The filled package is compressed, so that the contents form a compact whole. Then the compressed package is evacuated by means of a vacuum element which is connected to a small suction opening in the wall of the package, while the rest of the package is not subjected to vacuum.

Koelsch et al., U.S. Pat. No. 5,551,213 describes the invention relates to an apparatus and method for sealing objects in various size pouches. The apparatus comprises a frame having a support surface, a seal assembly including upper and lower sealing jaws a clamp assembly including upper and lower clamping jaws, and a snorkel assembly having a snorkel guide member telescopically surrounding a probe. The clamp assembly secures the pouch, and the probe is inserted into the pouch to evacuate the air from the pouch. Once the air is evacuated, the seal assembly seals the pouch, and the clamp assembly then releases the pouch.

Chi, U.S. Pat. No. 5,396,751 describes a vacuum ejector includes an air ejector connected to a vacuum pump by a tube and controlled by a control switch to withdraw air from a food container. The air ejector includes a cap for covering the food container, a plug fastened to the cap by a screw joint, a valve received within a top recess on the cap and coupled to the plug to control the air passage between the food container and the vacuum pump, and a connector detachably connected between the plug and the tube being connected to the vacuum pump. The vacuum effect can be achieved quickly and conveniently for keeping the food fresh or for other vacuum treatment.

Wallace, U.S. Pat. No. 5,228,271 describes an apparatus and method for evacuating a gas from a container having collapsible walls. The apparatus is especially useful for removing air from flexible collapsible containers which comprise soft goods such as disposable hospital gowns, surgical paper and plastic wastes which must be transported and disposed of in a safe fashion.

Akkala, U.S. Pat. No. 5,035,103 relates to the vacuum packaging of products and involves the use of heat sealable thermoplastic bag in conjunction with a vacuum dome having sealing edge disposed around its periphery and being connected to a source of vacuum, the thermoplastic bag being entirely closed except for an integral flat vent passage disposed at one peripheral location on the bag. One half of the vent passage is made up of material from one portion of the bag, and the other half of the vent passage is made up of a precisely equal amount of material from an opposite portion of the bag such that the interior surfaces of said vent passage can tend to adhere together. The novel method in accordance with this invention comprises the steps of placing the thermoplastic bag in a supportive device having a desired configuration, placing the vacuum dome over the vent passage so the vent passage protrudes into the interior of the vacuum dome, with the peripheral edge of the dome in contact with bag portions surrounding the vent passage reducing the pressure inside the dome so as to cause the egress of air from the interior of the bag out through the vent passage, thereafter removing the dome from contact with the bag, with the sidewalls of the vent member sealing together temporarily, and then taking the final step of heat sealing the opening of the vent passage to effectively prevent the return of air to the interior of the bag.

Sanderson, U.S. Pat. No. 4,754,595 describes a method for sterilizing and storing articles wherein a bag for containing articles to be sterilized is automatically sealed by means responsive to a sterilizing environment applied to the bag. One or more actuators are releasably attached to the bag to automatically close one or more valves at the appropriate point in a sterilizing cycle to result in a vacuumized sterile package.

Maruscak, U.S. Pat. No. 4,337,804 describes a household system wherein suction is provided through a needle valve that is connected to suction port of suction tube through flexible tube. Food placed and sealed in container is vacuum packed by penetrating a bladder section of container and removing air through needle valve.

The prior art teaches vacuum packing methods such as Aarts, as well as pouch vacuum sealing such as Koelsch et al. Wallace teaches a related method for vacuum packaging. However, the prior art does not teach a simple patch having a carrier layer, a self sealing layer and an adhesive layer providing a quick employment from the outside of the container only. The present invention fulfills these needs and provides further related advantages as described in the following summary.

SUMMARY OF THE INVENTION

The present invention teaches certain benefits in construction and use which give rise to the objectives described below.

The present invention provides a means and method of exhausting air from, and sealing a container of the type used for sealing food products. The means includes a self adhering patch for attachment to the exterior side wall of the container and a suction probe which may be attached to a source of suction such as a suction pump for drawing air from the container when the suction probe is inserted through the patch and into the container. When the air has been removed, the probe is removed and the patch closes to seal the puncture.

A primary objective of the present invention is to provide a means and method for exhausting air from a container having advantages not taught by the prior art.

Another objective is to provide such a means with a self sealing patch.

A further objective is to provide a self adhering patch with self sealing means and a suction probe capable of deforming the patch and a sidewall of the container and for enabling the self sealing function once the air has been exhausted from the container.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention. In such drawings.

DETAILED DESCRIPTION OF THE INVENTION

Figure 1:
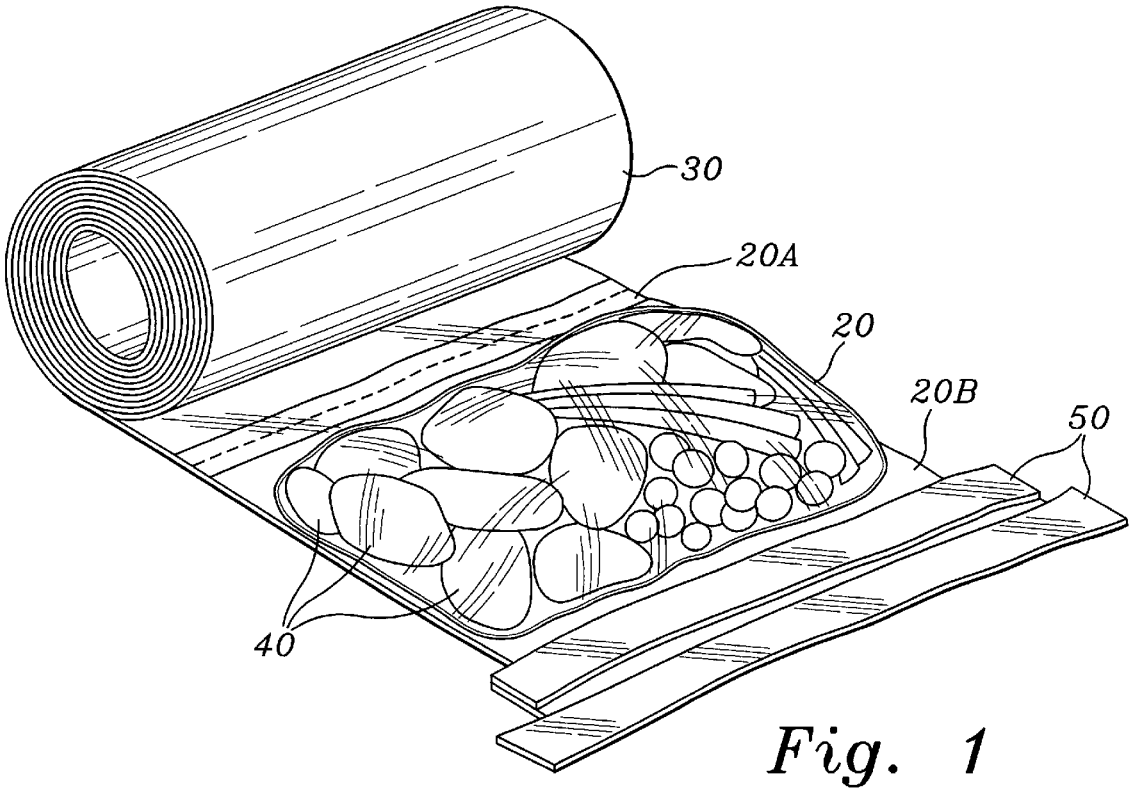
FIG. 1 is a perspective view of the invention showing a roll of tubular material for forming containers, as shown, for storing items therein.
Figure 2:
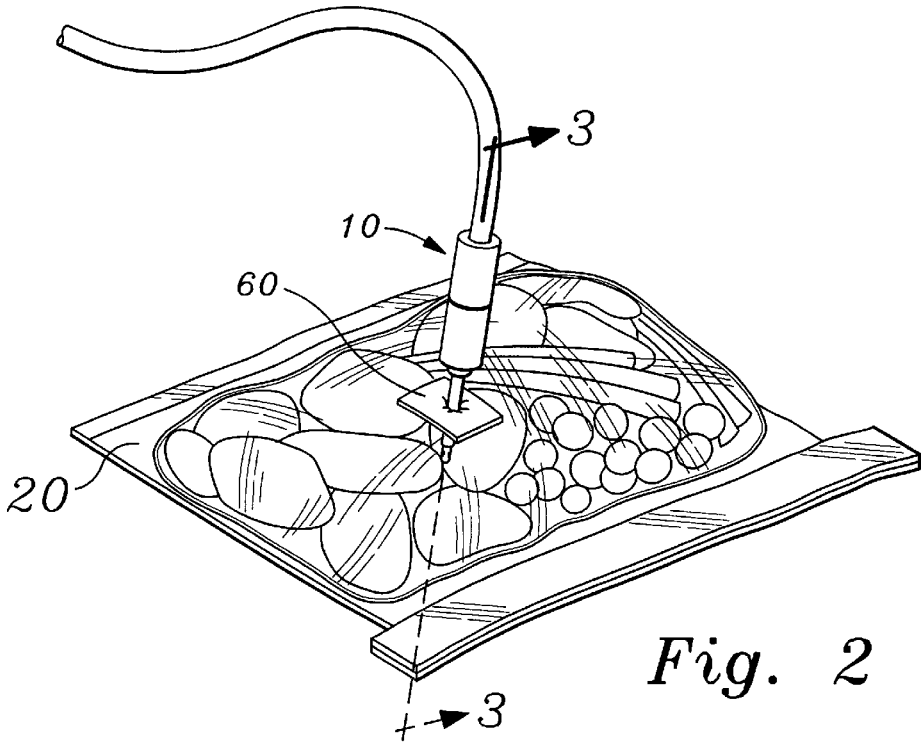
FIG. 2 is similar to FIG. 1 and further showing a sealing patch on the sidewall of the container and a means for drawing air from the container.

The above described drawing figures illustrate the invention, an apparatus for drawing air 10 in combination with a sealing container 20 preferably of the type made from a flexible plastic sheet material such as polyethylene, polypropylene or other inexpensive, flexible and transparent sheet stock as is well known in the art. Preferably, as shown in FIG. 1, the raw sheet material is unwound from a roll 30 as a tube and cut therefrom at any length desired so as to present two opposing open ends 20A and 20B. The container 20 preferably has an easily punctured container wall 22 (FIG. 3) by virtue of being a thin sheet, i.e., in the range of 0.001 to about 0.005 inches thick. Usually, one of the open ends 20A of the tube is sealed first and thereafter, the container 20 is loaded with items 40 to be stored. Following this, the other one of the open ends 20B of the container 20 is sealed. Sealing may be accomplished by merely thermally bonding the individual sheet portions of the tube to each other in a well known manner that is in widespread common practice. Alternately, sealing strips 50 may be used as is shown in FIG. 1. Sealing strips 50, commonly used in industry, are sealed in the same manner, by thermal bonding or chemical adhesive bonding, and provide a more robust sealed edge. The materials and technique of use described above are well known in the packaging industry and so will not be described further here.

Figure 3A:
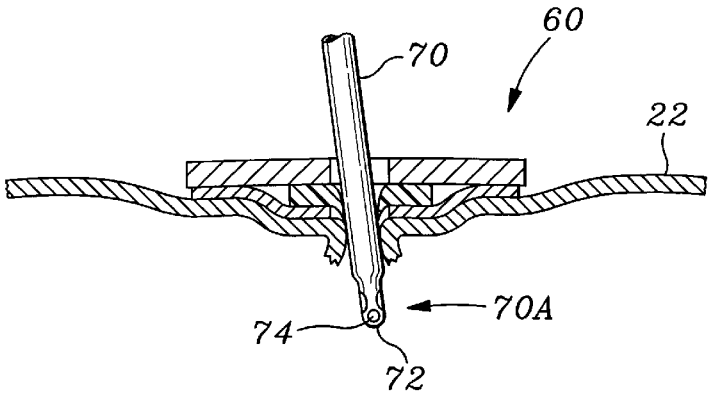
FIG. 3A is a partial sectional view thereof taken along line 3—3 of FIG. 2.
Figure 3B:
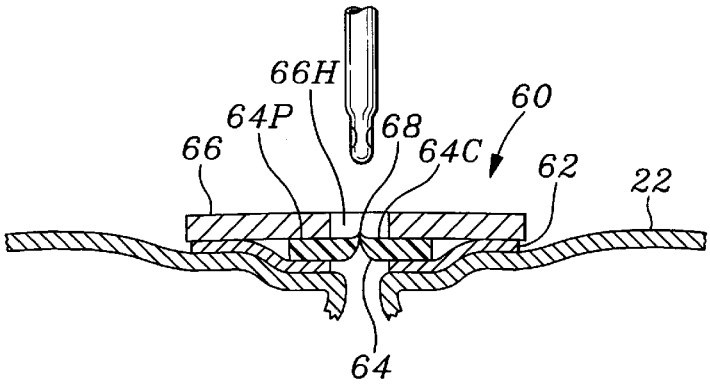
FIG. 3B is a partial sectional view thereof taken along line 3—3 of FIG. 2 and further showing a self sealing mechanism of the invention.

The invention, as described below, involves taking further steps and includes both the apparatus for removing the air 10 of the now sealed container 20, as well as a particular method for accomplishing the air removal. A sealing patch 60 of the invention provides, first of all, a means for adhesion 62 of the sealing patch 60 to the container wall 22. Secondly it provides a self sealing membrane 64 is placed so as to be in contact with the container wall 22 or to lay adjacent to the container wall 22 as is shown in FIGS. 3A and 3B. Such a self sealing membrane 64 is known in the art, and is generally comprised of a rubber or rubber like material of a highly flexible and adhesive nature. Such a material has a good memory so as to naturally tend to resume its former physical positional state once it is deformed such as by being punctured. Preferably, the adhesion means 62 is a bonding layer, such as an industrial adhesive, placed between a peripheral portion 64P of the self sealing membrane and the container wall and therefore leaving an area 64C of the membrane free of the adhesion means. A top carrier sheet 66, preferably of a non-elastic tape material is used to establish a body and rigidizing structure to the patch 60.

Figure 4:
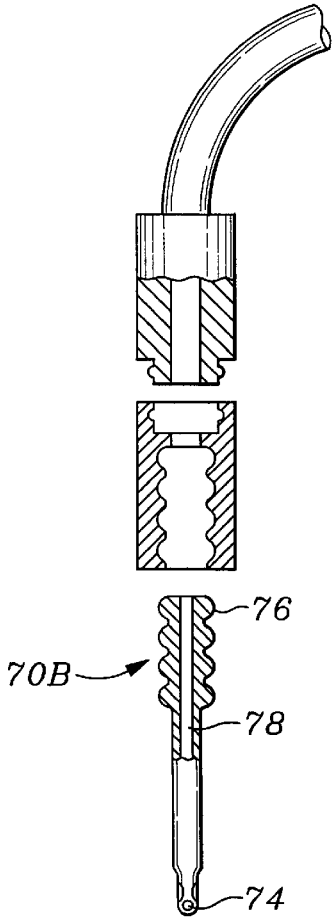
FIG. 4 is an exploded, partial sectional view thereof taken along line 3—3 in FIG. 2 and shows a suction probe used in the invention.

For removing the air from the container 20 a rigid, elongate probe 70 is provided. At a distal end 70A of the probe 70, a tip 72 having an air admittance aperture means 74, such as one or more holes, is provided, while at a proximal end thereof 70B, a suction device engagement means 76, such as a machine screw thread, as shown in cross-section in FIG. 4, is provided. An internal conduit 78 is provided for conducting air therethrough from the air admittance aperture means 74 to the suction device engagement means 76 as is well shown in FIG. 4. Preferably, the tip of the elongate probe 70 is formed for easily puncturing the self sealing membrane 64 and the container wall 22, as by rounding as shown, or by pointing the tip 72.

Preferably, the self sealing membrane 64 provides elastic and self adhering properties so as to tenaciously adhere to itself and further, to non-tenaciously adhere to the elongate probe 70, so that as the probe 70 is withdrawn from the self sealing membrane 64, a portion 68 of the membrane 64 is drawn into a puckered configuration and upon separation of the probe therefrom, the puckered portion closes to form a seal so that air cannot move into the container 20.

The instant invention includes a method of use for removing air from the container 20 and of thereafter sealing the container 20 and this method comprising the steps:

a) adhering the self sealing membrane 64 to a sidewall 22 of a container 20;

b) puncturing the self sealing membrane 64 and the container sidewall 22 with a suction probe 70;

c) sucking the air out of the container 20;

d) withdrawing the suction probe 70 from the container 20 in such a manner as to form a puckered portion 68 of the self sealing membrane 64; and e) sealing the self sealing membrane 64 by drawing the puckered portion 68 away from the container 20 so as to self engage and self adhere the puckered portion 68 for closing the self sealing portion 64 over the punctured portion of the container 20.

It is clear that the most important aspect of the present invention includes a self sealing membrane layer 64 sandwiched between a means for adhesion layer 62 placed peripherally against and bonded to one side of the membrane layer, and a top carrier sheet 66 of a non-elastic tape, the carrier sheet overlaying the membrane layer 64 and in contact with the other side thereof, the carrier providing a hole therein 66H aligned with the portion of the membrane layer 64 not covered by the adhesion layer 62. Such a construction is particularly novel and highly useful in fulfilling the objects of the present invention.

It is also clear that the present invention, in its elemental form, might simply include a container, preferably a plastic baggie, possibly of the type that has a self sealing opening or Ziplock®, wherein the container is manufactured with the self-sealing membrane layer 64 attached to one side of the baggie and overlayed by a thin plastic cover layer 66 which fully covers the membrane layer 64 and is, itself, attached peripherally to the baggie so as to assure the positioning and maintenance of the membrane layer 64. Such a top layer does not require hole 66H as a hole may be formed by tip 72 of the probe 10. In use, the probe 10 is inserted through the top layer 66, the membrane layer 64, and the side wall of the baggie 22 to gain admittance to the interior of the baggie. In this embodiment adhesive layer 62 is not required.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. An apparatus for drawing air in combination with a sealing container, the combination comprising:

a container having an easily punctured container wall;

a sealing patch providing a bonding layer in contact with and adhered to the container wall, a carrier sheet of a non-elastic tape fixed to the bonding layer, and a self sealing membrane layer sandwiched between the bonding layer and the carrier sheet, the carrier sheet providing a probe hole therein aligned with a portion of the self sealing membrane layer not covered by the bonding layer; and a rigid, elongate probe providing, at a distal end thereof, a tip having an air admittance aperture means, at a proximal end thereof, a suction device engagement means and an internal conduit for conducting air therethrough from the air admittance aperture means to the suction device engagement means.

2. The apparatus of claim 1 wherein the container wall is made of a flexible plastic sheet material.

3. The apparatus of claim 1 wherein the tip of the elongate probe is formed for easily puncturing the self sealing membrane and the container wall.

4. The apparatus of claim 1 wherein the self sealing membrane provides elastic and self adhering properties so as to tenaciously adhere to itself and further, to non-tenaciously adhere to the elongate probe, so that as the probe is withdrawn from the self sealing membrane, a portion thereof is drawn into a puckered configuration and upon separation of the probe therefrom, the puckered portion closes to form a seal so that air cannot move into the container.

* * * * *